US005769763A

United States Patent [19]

Lochbaum

[11] Patent Number: 5,769,763

[45] Date of Patent: Jun. 23, 1998

[54] STABILIZER FOR AQUATIC EXERCISE

[76] Inventor: Kenneth Lochbaum, 3002 E. 38th St., Erie, Pa. 16510

[21] Appl. No.: 772,433

[22] Filed: Dec. 23, 1996

Related U.S. Application Data

[60] Division of Ser. No. 451,674, May 26, 1995, Pat. No. 5,611,763, which is a continuation-in-part of Ser. No. 365,498, Dec. 28, 1994, Pat. No. 5,533,960.

[51] Int. Cl.[6] ..... A63B 21/008

[52] U.S. Cl. ..... 482/111; 482/148

[58] Field of Search ..... 482/148, 111, 482/54, 70, 71, 57

[56] References Cited

U.S. PATENT DOCUMENTS

| | | | |
|---|---|---|---|
| 2,875,528 | 3/1959 | Garate . | |
| 3,415,475 | 12/1968 | Goodman . | |
| 3,861,675 | 1/1975 | Hopper . | |
| 4,145,044 | 3/1979 | Wilson et al. . | |
| 4,170,799 | 10/1979 | Ratelband . | |
| 4,247,096 | 1/1981 | Schmitt . | |
| 4,332,217 | 6/1982 | Davis | 482/54 |
| 4,576,376 | 3/1986 | Miller | 482/54 |
| 4,712,768 | 12/1987 | Gaudreau, Jr. | 482/54 |
| 4,759,544 | 7/1988 | Diaz . | |
| 4,784,385 | 11/1988 | D'Angelo . | |
| 5,219,317 | 6/1993 | Beasley . | |
| 5,234,391 | 8/1993 | Shasek et al. | 482/111 |
| 5,242,352 | 9/1993 | Elliott . | |
| 5,295,929 | 3/1994 | Weisz | 482/54 |
| 5,372,564 | 12/1994 | Spirito . | |
| 5,558,604 | 9/1996 | Hopkins | 482/54 |

*Primary Examiner*—Lynne A. Reichard
*Attorney, Agent, or Firm*—Lovercheck and Lovercheck

[57] ABSTRACT

The stabilizer devices for aquatic exercising and a device for aquatic exercise are disclosed. The stabilizers may be fixed to the side walls or bottom of a container of water to hold a person in an exercising position. The stabilizers may be made of plastic plumbing pipe and fittings may be portable, supported on, or fixed permanently in position on a container of water. The stabilizers may be rigid or flexible, may be completely immersed in water.

15 Claims, 3 Drawing Sheets

STABILIZER FOR AQUATIC EXERCISE

BACKGROUND OF THE INVENTION

This application is a Division of Ser. No. 08/451,674, filed May 26, 1995, which is a continuation-in-part application of Ser. No. 08/365,498 filed Dec. 28, 1994.

It is difficult for a person to maintain an exercise position in water during aquatic exercises without a stabilizer. According to the Archimedes Principle, a body immersed in water is buoyed up by a force equal to the weight of water displaced by the body. A human body will float when totally immersed in water and a very small force will move the body. Therefore, to hold themselves in place during aquatic exercise, persons must attach themselves to, hold onto, or otherwise engage a stabilizer. The stabilized person can then use their body and muscles much more efficiently and properly than when unstabilized. This greater efficiency allows the proper muscles to be strengthened. Stabilizers become more necessary the more completely the body is immersed in the water due to the buoyancy of the water.

Applicant's stabilizer can be cemented, bolted or otherwise permanently attached to the sides or bottom of a pool. Applicant's stabilizer can also be made portable, for example, by means of suction cups or other removably attaching means, which may be affixed to the pool wall or bottom, and hold the stabilizer in position. This position can then be changed, adjusted or moved, the stabilizer could even be taken to another body of water. The stabilizer can also be temporarily attached to the attaching base disclosed in co-pending application Ser. No. 08/365,498. This structure permits quick adjustments in the position of the stabilizers to accommodate different position needs for different exercises.

The design of the stabilizers can be any shape or form depending on the stabilizer's purpose, or the particular muscle to be strengthened or stretched.

Applicant's drawings show examples of stabilizing devices which can be permanent, portable or temporary, according to the way they are attached to the side or bottom of the pool.

Applicant is aware of the following U.S. Pat. Nos.: 2,875,528 to Garate; 3,415,475 to Goodman; 3,861,675 to Hopper; 4,145,044 to Wilson; 4,170,799 to Ratelband; 4,247,096 to Schmitt; 4,759,544 to Diaz; 4,784,385 to D'Angelo; 5,219,317 to Beasley; 5,242,352 to Elliott; and, 5,372,564 to Spirito.

SUMMARY OF THE INVENTION

Applicant has provided several examples of stabilizers which may be used by an exerciser to support themselves in water in an exercise position relative to the exercise device. The stabilizers may be secured to a base and provide a structure to engage the exerciser. A structure may be provided to engage the body of the exerciser in a standing, sitting or other position. Flexible straps may be provided to secure the exerciser to the stabilizer.

It is an object of the present invention to provide a stabilizer for aquatic exercise that is simple in construction, economical to manufacture and simple and efficient to use.

It is another object of the present invention to provide a stabilizer that can be fixed in position in a body of water and the body of a person can engage the stabilizer to hold the body in exercise position in the water.

It is another object of the present invention to provide a stabilizer which is portable.

It is another object of the present invention to provide a stabilizer that can be used in any depth of water or while the person exercising is fully immersed in the water.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
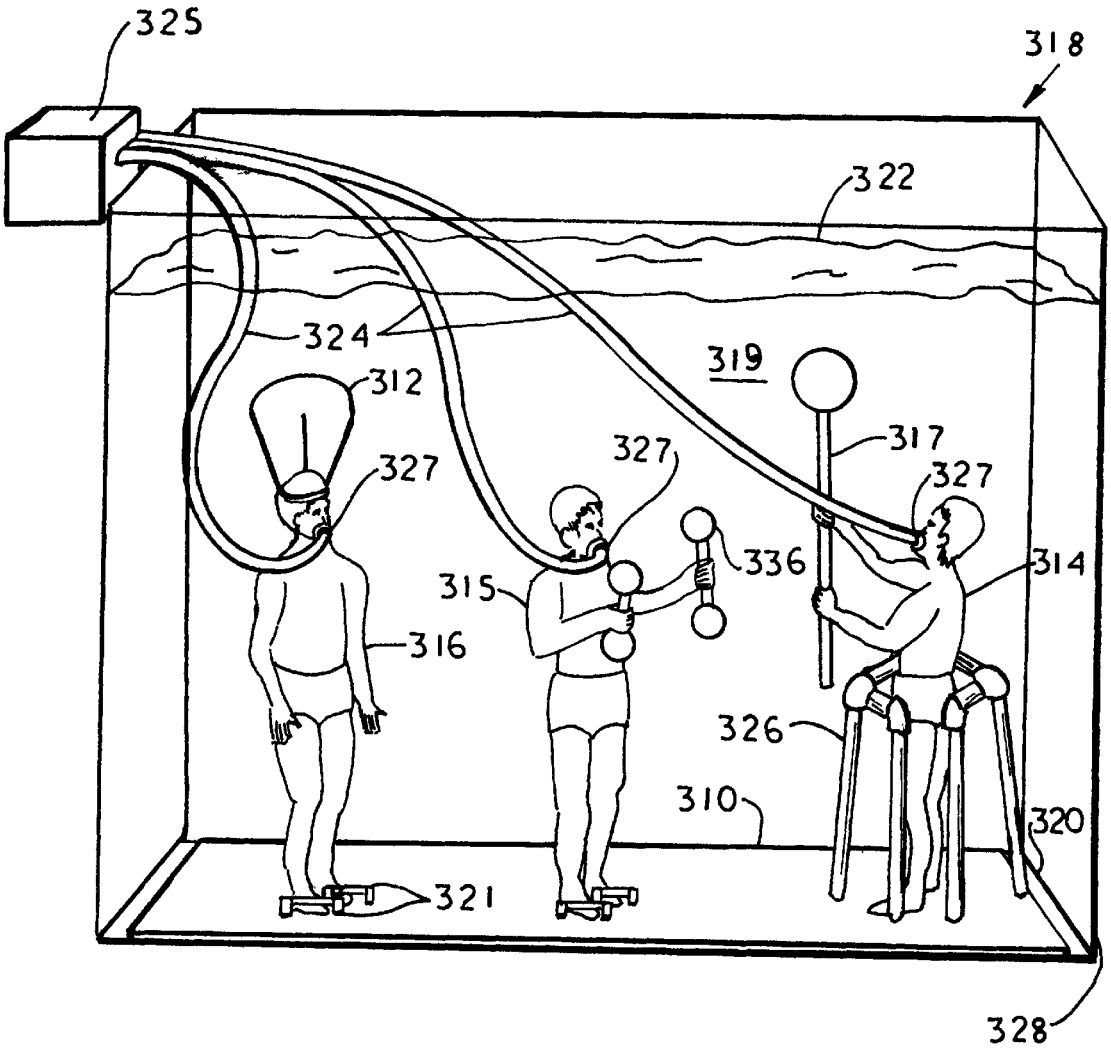
FIG. 1 is a side view of a deep pool showing air being supplied to persons exercising who are secured in an exercise position with stabilizers that are using various water resistance exercise devices.

Now with more particular reference to the drawings, FIG. 1 shows a deep water exercise pool where persons exercising 314,315,316 are completely immersed in water 319. Pool or container of water 318 has pool sides 328. Water 319 is sufficiently deep from bottom 320 to top surface 322 so that the person exercising may use a water resistant device such as golf club 317 above his head without the water resistance device leaving or partially leaving water 319. Therefore, the resistance function of the device is maintained throughout the exercise. Base 310 may be placed on bottom 320 on which foot stabilizers 321 may be fixed to bottom 320 or releasably secured to base 310 to support persons exercising 314,315,316 in exercise positions. Air supply lines 324 supply air to persons exercising 314,315, 316 from air supply means 325. Air is breathed by persons exercising 314,315,316 through air regulator 327. Torso engaging stabilizer means 326 comprises upright members which partially surround person exercising 314 to secure him in an exercise position. The person may be secured to or engaged by the stabilizer means.

Exercise person 314 is exercising with water resistance golf club 317 or other water resistant handled sports implement such as a tennis racquet, bat and so on. Exercise person 315 is exercising with hand held water resistant devices which are useful for simulated exercises. Exercise person 316 has neck exercising device 312 comprising water resistant member upwardly extending from head engaging attachment which secures the device to the head of exercise person 316 whereby the neck may be exercised by movement of resistance member through water 319.

Figure 2:
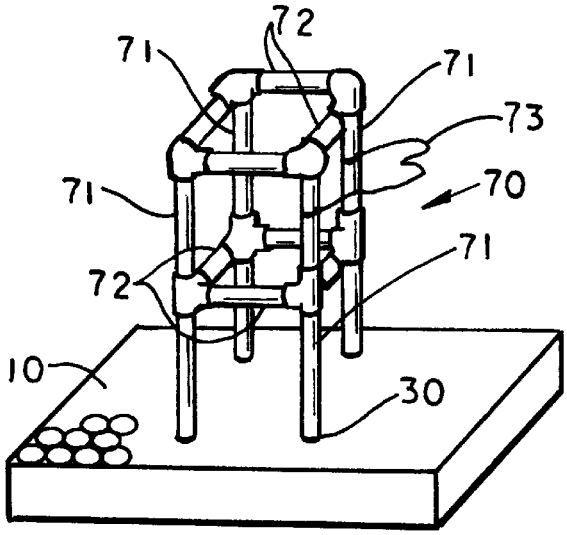
FIG. 2 is a stabilizer with a base and four upright members and a flexible belt.

FIG. 2 shows another embodiment of stabilizer 70 which is like stabilizer 326 in FIG. 1, with four upright members 71, cross members 72 and belt 73.

Figure 3:
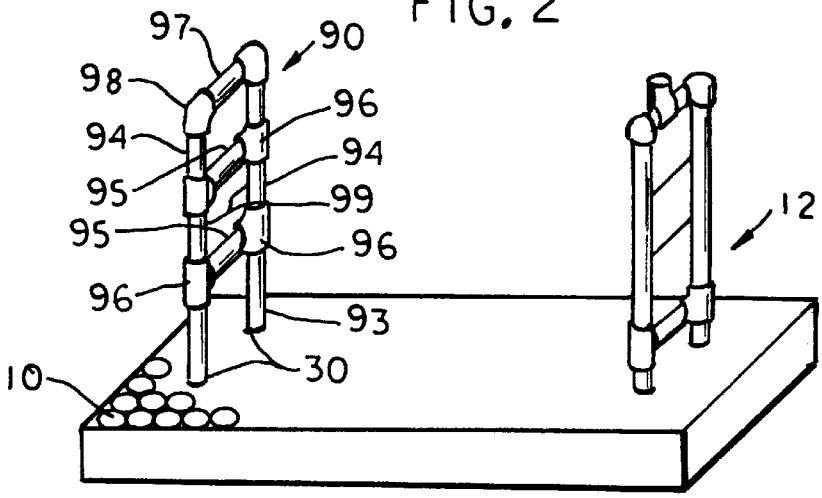
FIG. 3 is an isometric view of an upright stabilizer with a belt for engaging the body of a person and an exercise device on the base.

FIG. 3 shows stabilizer 90 and exercising device 12. Stabilizer 90 has upright members 94 having lower ends 93 received in holes 30 in base member 10. Flexible belt 99 is attached to upright members 94. Upright members 94 and transverse member 95 are held together by plastic plumbing T-fittings 96. Transverse member 97 is attached to elbows 98.

Figure 4:
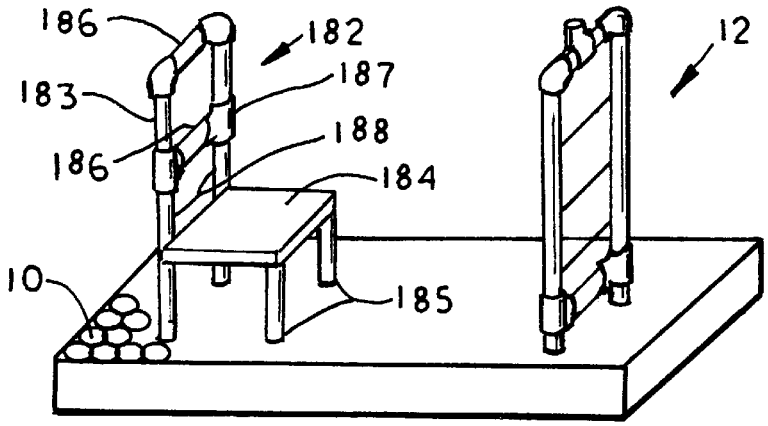
FIG. 4 is an isometric view of a base having a chair stabilizer and an exercise device.

FIG. 4 shows exercise device 12 like shown in FIG. 9 and chair 182. Chair 182 has upright members 183, seat 184 and legs 185. Legs 185 are attached to the corners of seat 184. Upright members 183 are rigidly supported generally parallel to each other by cross members 186 and T-fittings 187. Lower ends of upright members 183 and legs 185 are received in openings 30 in base 10. One or more belts 188 may be provided to secure person 14 in a desired exercise position on chair 182.

Figure 5:
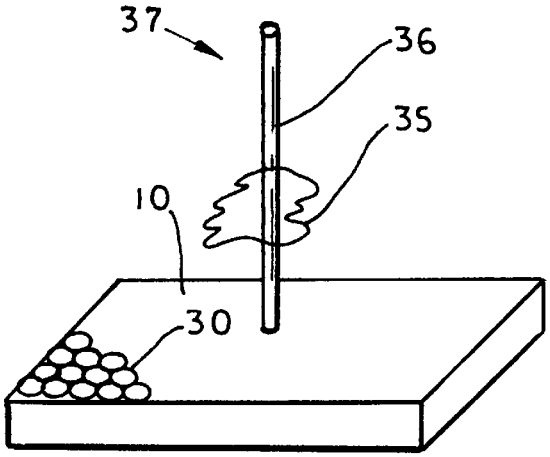
FIG. 5 is an isometric view of a single upright stabilizer on a base and a belt.

FIG. 5 shows another embodiment of the stabilizer having upright bar 36 received in opening 30 in base member 10 and flexible stabilizing member 35 is attached to bar 36. Base member 10 is made like FIG. 1.

Figure 6:
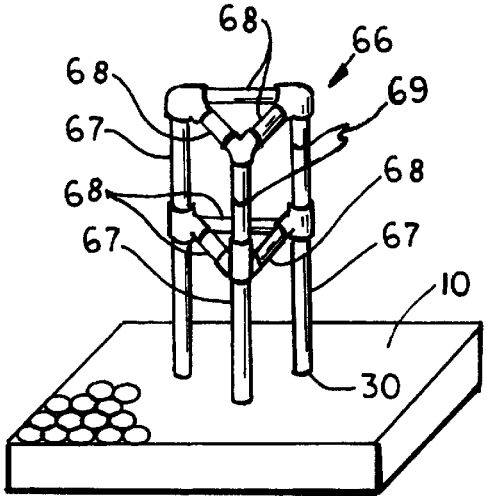
FIG. 6 is an isometric view of a base and a stabilizer having three upright members.

FIG. 6 shows stabilizer 66 which may be made up of three upright members 67 which are rigidly held together generally parallel to each other by cross members 68. The lower ends of upright members 67 are received in openings 30 in base 10. One or more restraining means or belt 69 may be provided to secure person 14 to stabilizer 66 to maintain person 14 in a desired exercise position relative to stabilizers or other devices.

Figure 7:
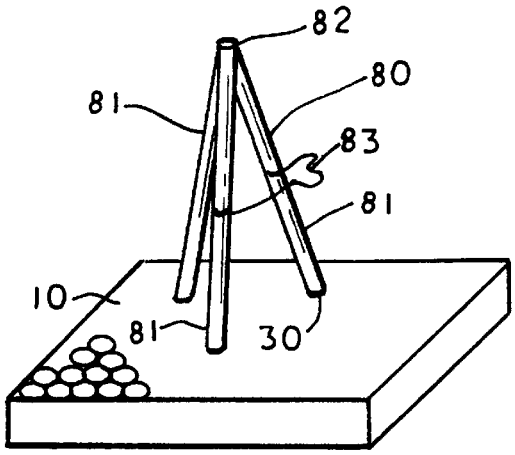
FIG. 7 is an isometric view of a base and three inclined members.

FIG. 7 shows stabilizer 80 having inclined members 81 connected at upper end 82 with lower ends received in openings 30 in base 10 and restraint 83.

Figure 8:
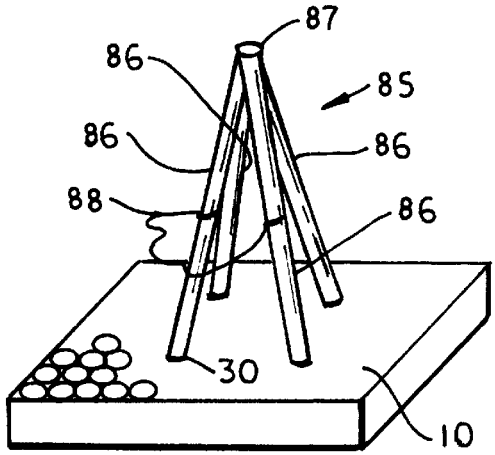
FIG. 8 is an isometric view of a stabilizer with a base and four inclined members.

FIG. 8 shows stabilizer 85 and four inclined members 86 supported in openings 30 on base member 10 and joined together by top member 87. The lower ends of inclined member 86 are inserted into openings 30 in base 10. Belt restraint 88 is attached to upright member 86.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A stabilizing device for use with aquatic exercise equipment comprising a base resting on the bottom of a body of water;

said base having an aperture;

a support member having a first end received in said aperture;

said support member having a second and spaced from said aperture;

body engaging means fixed to said support member for engaging the body above the feet of an exercising person while leaving the hands and arms free;

said body engaging means comprising a flexible belt.

2. The device recited in claim 1 wherein said support member comprises a post.

3. The device recited in claim 2 wherein said post is made of pipe made of thermoplastic material.

4. The device recited in claim 1 wherein said device comprises three posts held together by plastic plumbing fittings.

5. The device recited in claim 1 wherein said device comprises posts made of two pieces of pipe held together by thermoplastic plumbing fittings.

6. The device recited in claim 1 wherein said top surface of said base provides a surface for an exercising person to stand on.

7. A stabilizing device for use with aquatic exercise equipment comprising a base resting on the bottom of a body of water;

said base having an aperture;

a support member having a first end received in said aperture;

said support member having a second end spaced from said aperture;

body engaging means fixed to said support member for engaging the body above the feet of an exercising person while leaving the hands and arms free;

said base is made of short pieces of pipe with open upward ends and attached together to form a support surface.

8. The device recited in claim 7 wherein said top surface of said base provides a surface for an exercising person to stand on.

9. A stabilizing device recited in claim 7 for use with aquatic exercise equipment comprising a base resting on the bottom of a body of water;

said base having an aperture;

a support member having a first end received in said aperture;

said support member having a second end spaced from said aperture;

body engaging means fixed to said support member for engaging the body above the feet of an exercising person while leaving the hands and arms free.

10. A stabilizing device for resistive element aquatic exercise in a container of water having bottom and side walls;

attaching means attaching said stabilizing device to said container;

a body engaging means on said stabilizing device for engaging said body above the foot of a person during aquatic exercise said attaching means comprises a base resting on said bottom, a top surface on said base having at least one aperture extending into said base;

said stabilizing device comprises a stabilizing portion and a post;

said aperture receiving and releasably securing said post whereby said stabilizing device is releasably secured to said base;

said body engaging means comprising a flexible belt.

11. The device recited in claim 10 wherein an array of said apertures are formed in said top surface of said base; and, said apertures are disposed closely adjacent to one another and are generally disposed in rows and columns.

12. The device recited in claim 10 wherein said top surface of said base provides a surface for an exercising person to stand on.

13. A stabilizing device for resistive element aquatic exercise in a container of water having bottom and side walls;

attaching means attaching said stabilizing device to said container;

a body engaging means on said stabilizing device for engaging said body above the foot of a person during aquatic exercise said attaching means comprises a base resting on said bottom, a top surface on said base having at least one aperture extending into said base;

said stabilizing device comprises a stabilizing portion and a post;

said aperture receiving and releasably securing said post whereby said stabilizing device is releasably secured to said base;

said base is made of short pieces of pipe with open upward ends and attached together to form a support surface with openings for receiving posts of stabilizing equipment.

14. The device recited in claim 7 wherein said top surface of said base provides a surface for an exercising person to stand on.

15. The device recited in claim 1 wherein said device has four posts held together by thermoplastic T's and elbows attached to said pipe.

* * * * *